US009393482B2

(12) United States Patent
Johnston

(10) Patent No.: US 9,393,482 B2
(45) Date of Patent: Jul. 19, 2016

(54) SNOW CLIMBING PLATE FOR USE WITH A CRAMPON

(71) Applicant: Jon Johnston, Pemberton (CA)

(72) Inventor: Jon Johnston, Pemberton (CA)

( * ) Notice: Subject to any disclaimer, the term of this patent is extended or adjusted under 35 U.S.C. 154(b) by 375 days.

(21) Appl. No.: 13/667,893

(22) Filed: Nov. 2, 2012

(65) Prior Publication Data

US 2014/0123521 A1 May 8, 2014

(51) Int. Cl.
*A63C 13/00* (2006.01)
*A43C 15/06* (2006.01)

(52) U.S. Cl.
CPC ..... *A63C 13/003* (2013.01); *A43C 15/068* (2013.01); *A63C 13/005* (2013.01); *A43C 15/06* (2013.01); *A63C 2203/06* (2013.01)

(58) Field of Classification Search
CPC ..... A43B 5/04; A43B 5/0401; A43B 5/0404; A63C 13/003; A63C 13/005; A63C 13/006; A63C 2203/06; A43C 15/06; A43C 15/068; A43C 15/061; A43C 15/063; A43C 15/065; A43C 15/066
USPC ..... 36/116, 122, 7.1 R, 7.7, 7.6, 59 R
See application file for complete search history.

(56) References Cited

U.S. PATENT DOCUMENTS

| | | | | | |
|---|---|---|---|---|---|
| 3,600,829 | A * | 8/1971 | Violette | 36/124 | |
| 5,966,844 | A * | 10/1999 | Hellerman et al. | 36/122 | |
| 5,970,632 | A * | 10/1999 | Watson | 36/122 | |
| 6,185,846 | B1 * | 2/2001 | Neidhardt, Jr. | 36/124 | |
| 6,256,908 | B1 * | 7/2001 | Warner | 36/124 | |
| 6,481,121 | B1 * | 11/2002 | Tucker | A43B 13/26 | 36/15 |
| 6,964,118 | B2 * | 11/2005 | Parisotto | A43C 15/061 | 36/62 |
| 2002/0178611 | A1 * | 12/2002 | Farys | A43B 5/002 | 36/7.6 |
| 2003/0101623 | A1 * | 6/2003 | Settelmayer | 36/124 | |
| 2005/0046149 | A1 * | 3/2005 | Ekberg | 280/601 | |
| 2007/0289169 | A1 * | 12/2007 | Gallay et al. | 36/125 | |
| 2008/0178494 | A1 * | 7/2008 | Gallay et al. | 36/124 | |
| 2008/0263902 | A1 * | 10/2008 | Chartrand et al. | 36/122 | |
| 2012/0151802 | A1 * | 6/2012 | Lin | 36/122 | |

* cited by examiner

*Primary Examiner* — Khoa Huynh
*Assistant Examiner* — Jocelyn Wu
(74) *Attorney, Agent, or Firm* — Lowe Graham Jones PLLC

(57) ABSTRACT

A snow climbing plate is disclosed including heel and toe binding receivers. Heel and toe bindings for a crampon positioned beneath the plate extend through the receiver and secure to a boot. An instep portion of the plate is captured between the heel and toe bindings. The plate extends laterally beyond the crampon and may extend one or both of rearwardly and forwardly beyond the crampon. The receivers may be embodied as an aperture in the plate or a notch extending inward from an end of the plate. Apertures may be provided to admit tabs for engaging a heel of the boot secured to the crampon.

12 Claims, 12 Drawing Sheets

SNOW CLIMBING PLATE FOR USE WITH A CRAMPON

FIELD OF THE INVENTION

This application relates to snowshoes and crampons for use in mountaineering and backcountry skiing.

BACKGROUND OF THE INVENTION

A mountaineer or backcountry skier is likely to encounter a variety of conditions in an alpine environment. While hiking and climbing one may be required to cross exposed rock, a scree slope, glacial ice, crusted snow, heavy wet snow, powdered snow, and the like. Even where the environment is uniformly covered in snow, the type of snow will not generally be uniform. Although crampons are often used for traction on ice and hardened snow, they are not suitable for soft snow. Likewise, snow shoes are only suitable for soft snow and are not ideal for climbing steeper pitches. Switching between crampons and snow shoes while carrying a pack or skis and wearing heavy winter clothes and gloves is particularly inconvenient.

Accordingly, it would be an advancement in the art to provide a lightweight means for accommodating varying snow conditions with increased convenience.

SUMMARY OF THE INVENTION

In one aspect of the invention, a snow climbing plate is disclosed for use with a crampon having spikes protruding from a lower surface of a sole portion thereof and heel and toe bindings extending from an upper surface of the sole portion, the heel and toe bindings being positioned to secure a boot to the crampon. The snow climbing plate includes a generally planar member having a lower surface and an upper surface opposing the lower surface, the planar member having a greater lateral extent than the sole portion. The planar member further includes a binding receiver positioned to receive one of the heel and toe bindings of the crampon when secured to the boot having the planar member positioned between the boot and the crampon and a portion of the planar member captured between the heel and toe bindings of the crampon. In some embodiments, the binding receiver is a heel binding receiver and the planar member further includes a toe binding aperture positioned to receive the toe binding when the heel binding is positioned in the heel binding receiver. In other embodiments, the planar member further includes a notch extending from a toe end of the planar member toward the heel aperture and positioned to receive the toe binding.

In another aspect of the invention, at least one rib is secured to or extends from the lower surface of the planar member and may extend from a lateral edge of the planar member and extend downwardly from the lower surface.

In another aspect of the invention, the planar member further comprises at least one heel tab aperture positioned rearwardly of the heel binding receiver and sized and positioned to receive at least one heel tab secured to the sole portion of the crampon.

In another aspect of the invention, the planar member extends one or both of rearwardly and forwardly from the sole portion of the crampon.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
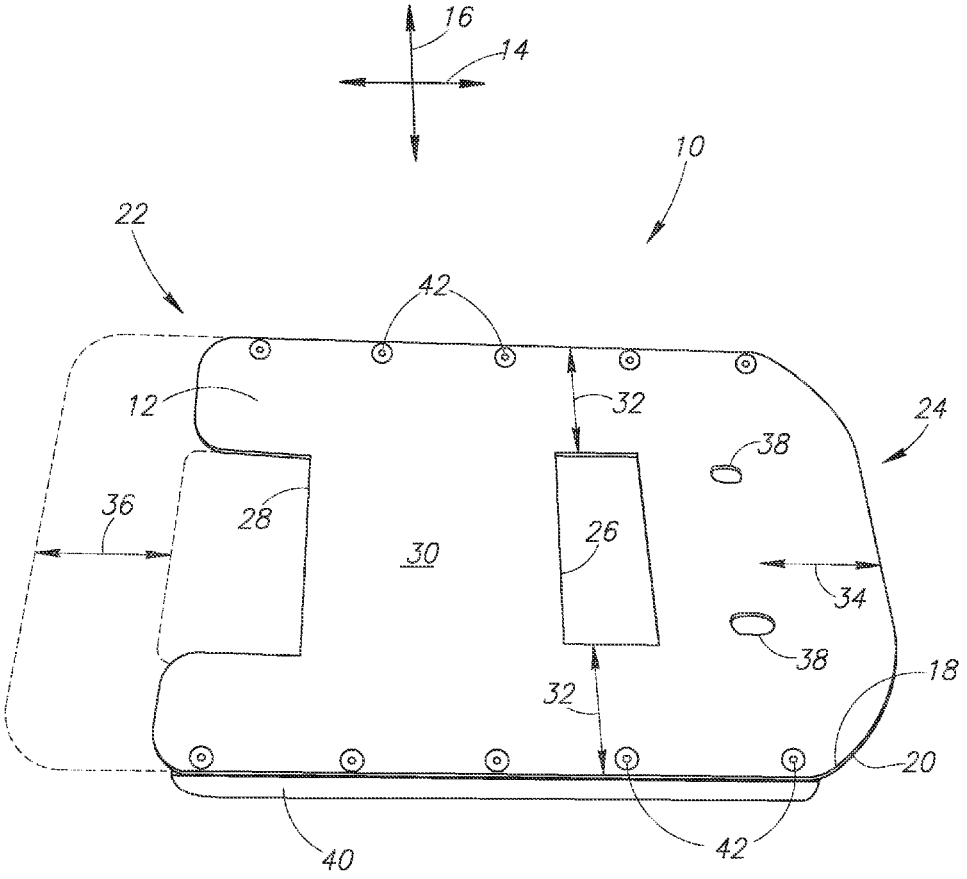
FIG. 1 is an perspective view of a snow climbing plate in accordance with an embodiment of the present invention.

FIG. 1 illustrates a snow climbing plate 10 suitable for use with a crampon secured to a climbing boot. The snow climbing plate 10 includes a planar member 12. The planar member 12 may be formed from one or more lightweight materials, such as carbon fiber composite material, aluminum, fiberglass composite material, or the like. The planar member 12 and the features thereof described below may be formed of a single monolithic piece of material or may be formed by fastening pieces of similar or dissimilar materials together to define the described features.

The snow climbing plate 10 may define a longitudinal direction 14 that is generally parallel to a front-to-back axis of a wearer and a lateral direction 16 that is generally parallel to a right-to-left axis of a wearer. The planar member 12 has an upper surface 18 and a lower surface 20 and defines a toe end 22 and a heel end 24.

The planar member 12 defines one or both of a heel binding receiver 26 and a toe binding receiver 28 positioned to receive a portion of the heel binding and toe binding, respectively, of a crampon. As shown in FIG. 1, the heel binding receiver 26 may be embodied as an aperture penetrating through the planar member 12 closer to the heel end 24 than to the toe end 22. The toe binding receiver 28 may be embodied as notch extending from the toe end 22 partially toward the heel binding receiver 26. An instep portion 30 of the planar member 12 may be positioned between the heel binding receiver 26 and the toe binding receiver 28. The instep portion 30 may be of a sufficient longitudinal width to support the weight of a user without deforming or excessively deflecting.

The planar member 12 may have a lateral extent 32 to either side of the heel and toe binding receivers sufficient to reduce the planar member's 12 tendency to sink into soft snow. A longitudinal length of the planar member may be such that the planar member 12 has a rearward extent 34 beyond one of the heel binding receiver 26, a sole portion of a crampon securing the planar member to a boot, and a sole portion of a boot secured to the planar member 12. As shown in FIG. 1, the toe binding receiver 28 is preferably embodied as a notch extending from the toe end 22 partially toward the heel binding receiver 26 leaving an instep portion 30. As shown in dotted lines, in some embodiments, the toe binding receiver 28 may be embodied as an aperture penetrating the planar member 12 and the planar member 12 in such embodiments may have an extent 36 beyond the toe binding receiver 28. The extent 36 of the planar member 12 beyond the toe binding receiver 28 may be curved or bent upward similar to a ski or conventional snow shoe and may likewise be tapered. As shown in the illustrated embodiments, corners of the planar member 12 may be rounded or otherwise chamfered or contoured.

The planar member 12 advantageously reduces the extent that a wearer's foot descends into snow. Accordingly, some or all of the lateral extent 32, rearward extent 34, and forward extent 36 may be effective to achieve this objective. As an example, the lateral extent 32 of the planar member 12 along a all or a major portion of the sole portion of a boot or crampon secured thereto may be between 25 and 100 percent of the width of one of the heel binding receiver 26, toe binding receiver 28, and the sole of a crampon or boot secured to the planar member 12. Likewise, one or both of the rearward extent 34 and forward extent 36 may be between 5 and 25 percent of one of the entire length of the planar member 12 and a sole of a crampon or boot secured thereto. The toe binding receiver 28 is preferably a notch or, if a forward extent 36 is included, the forward extent 36 it is preferably short. This arrangement facilitates steep climbing without having the climbing plate hang up in snow. Also, the short toe end of the plate allows the toe spikes of the crampon to bite into hard snow or ice without interference from the climbing plate.

In some embodiments, one of the heel binding receiver 26 and toe binding receiver 28 may be omitted such that one or both of the toe end 22 and heel end 24 does not include a notch or other feature engaging a crampon. In such embodiments, the positioning of a binding in whichever of the receivers 26, 28 that is not omitted and the capture of a portion of the planar member 12, such as the instep portion 30, between the toe and heel bindings of the crampon may be used to retain the snow climbing plate 10.

In some applications, a crampon used with the snow climbing plate may include tabs for retaining a heel of a boot. Accordingly, the planar member 12 may include one or more heel tab apertures 38 positioned rearwardly of the heel binding receiver 26 and sized to receive the heel tabs. In this and other embodiments disclosed herein, where a crampon does not include tabs, the heel tab apertures 38 may be replaced with tabs extending downwardly from the lower surface 20. The tabs may be formed by bending downwardly sections of the planar member 12. The planar member 12 may have a thickness such that a portion of the heel tabs extend above the upper surface 18 of the planar member 12 effective to engage a heel of a boot secured to the planar member 12.

The planar member 12 may be stiffened by one or more stiffening elements secured thereto. For example, in the illustrated embodiment, ribs 40 may be fastened to a lower surface 20 of the planar member and extend downwardly therefrom. The downward extension of the ribs also helps to increase traction of the climbing plate. Alternatively, the ribs 40 may secure to the upper surface 18 and extend upwardly. As shown in FIG. 1, the ribs 40 extend along the lateral edges of the planar member 12. However, one or more ribs 40 may also secure to the planar member 12 at any point inward from the lateral edges. In the illustrated embodiment, the ribs 40 are separate members that secure to the planar member 12 by means of fasteners 42, such as rivets, screws, welding, or the like. In other embodiments, ribs 40, or other stiffening elements, may be monolithically formed with the planar member 12 by means of milling, co-extrusion, bending, stamping, or other method of co-formation of both planar member 12 and ribs 40 or other stiffening elements.

Figure 2:
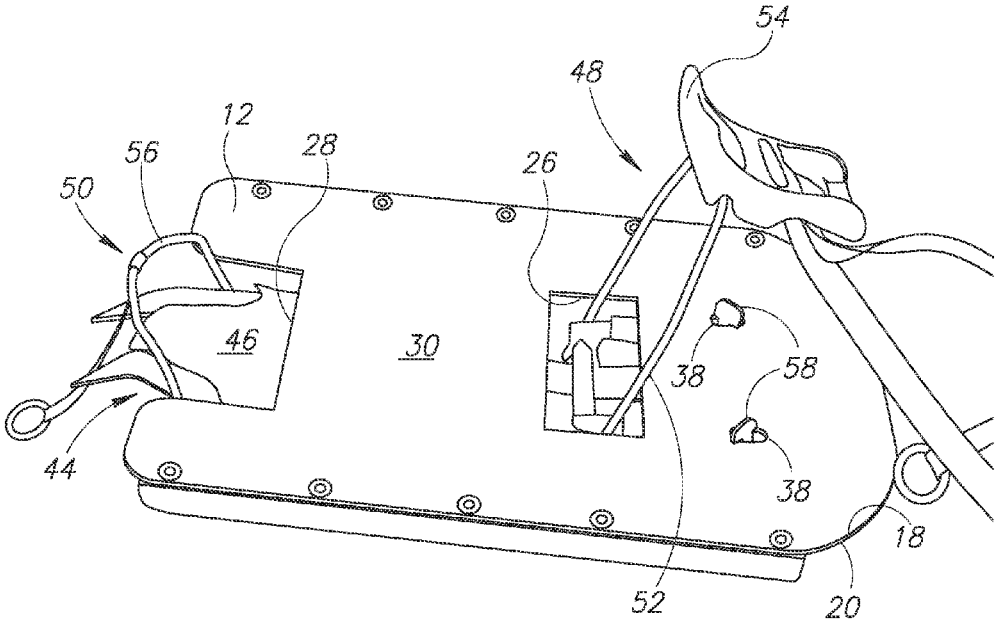
FIG. 2 is an perspective view of a snow climbing plate having a crampon positioned therebeneath in accordance with an embodiment of the present invention.

FIG. 2 illustrates a crampon 44 positioned beneath a snow climbing plate 12. The crampon 44 includes a sole portion 46 that is generally coextensive with a sole of a boot to which the crampon 44 is secured in normal use. As shown, the crampon 44 may be positioned below the lower surface 20 of the planar member 12 having the heel binding 48 extending through the heel binding receiver 26 and protruding above the upper surface 18. Likewise, the toe binding 50 extends through the toe binding receiver 28 and protrudes above the upper surface 18 of the planar member 12.

In the illustrated embodiment, the heel binding 48 includes a bail 52 with a clamping member 54, or toggle member, for engaging a boot. The bail 52 may be pivotally mounted to the sole portion 46. The toe binding 50 may likewise include a bail 56 or other member for capturing a portion of the toe of a boot. The bail 56, or other member, may be rigidly secured to the sole portion 46. In instances where the crampon 44 includes heel tabs 58, these tabs may be positioned within the heel tab apertures 38.

As noted above, the instep portion 30 of the planar member 12 is positioned between the bail 52 and the bail 56. In the illustrated embodiment, the planar member 12 extends rearwardly from the edge of the crampon 44 but does not extend forwardly from the sole portion 46 of the crampon 44. However, in some embodiments, the opposite may be true or the planar member 12 may extend both forwardly and rearwardly from the sole portion 46.

Figure 3A:
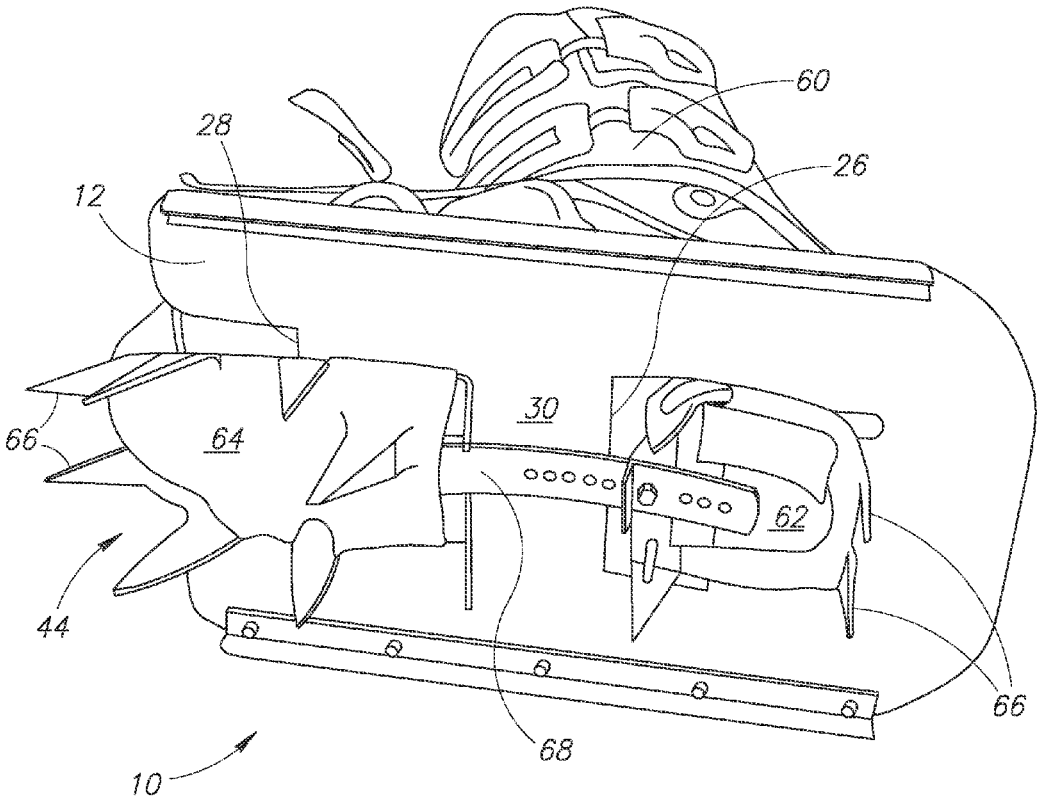
FIG. 3A is a lower perspective view of a snow climbing plate interposed between a crampon and boot in accordance with an embodiment of the present invention.
Figure 3B:
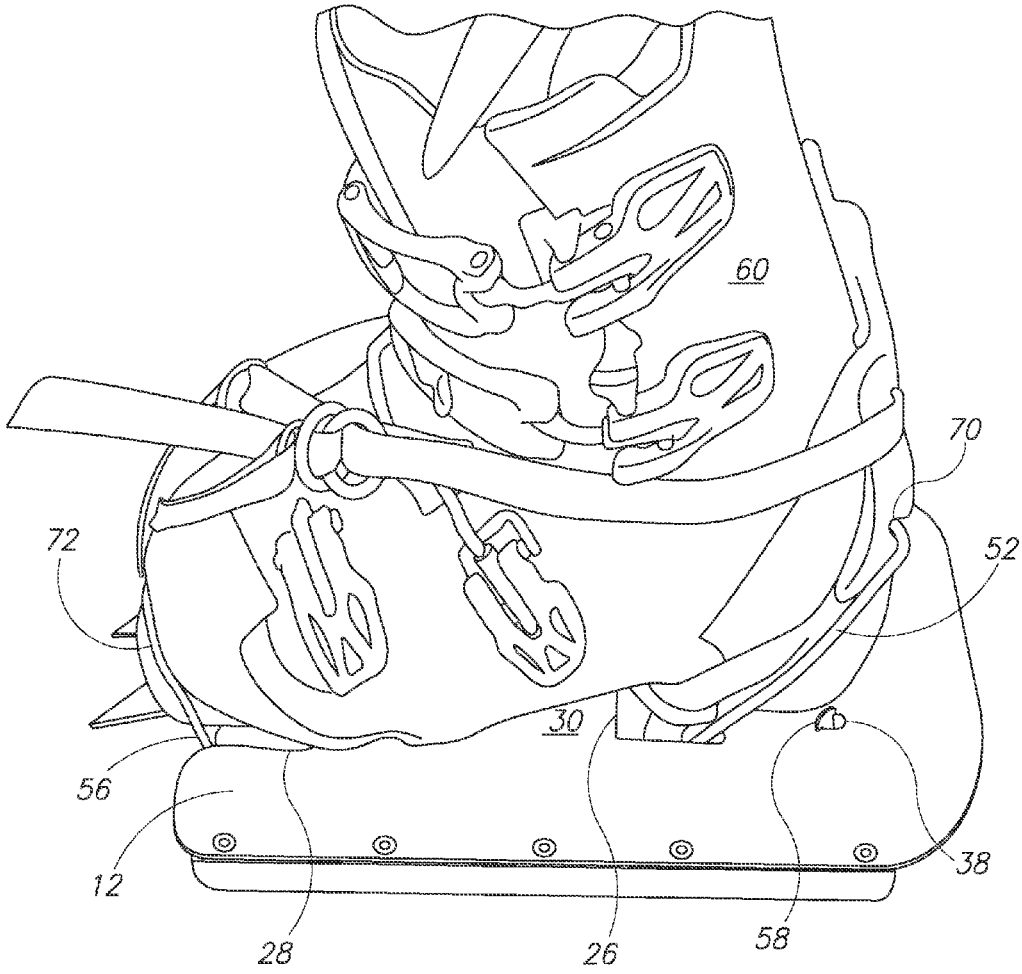
FIG. 3B is an upper perspective view of a snow climbing plate interposed between a crampon and boot in accordance with an embodiment of the present invention.

FIGS. 3A and 3B illustrate a snow climbing plate 10 and crampon 44 secured to a boot 60. With respect to the crampon 44, some crampons are length-adjustable to accommodate differently sized boots. Accordingly, a crampon 44 may include a heel portion 62 and a toe portion 64. For purposes of this disclosure, the toe portion 64 may correspond to a toe portion, ball portion, and all or part of an instep of a foot or shoe. Likewise, the heel portion 62 may correspond some or part of the instep of a foot or shoe as well as the heel portion. Each of the heel portion 62 and toe portion 64 include a plurality of spikes 66 for gripping snow and ice as known in the art.

An adjustment member 68 may secure the heel portion 62 and toe portion 64 to one another. In the illustrated embodiment, the adjustment member 68 is a metal strip secured to one of the portions 62, 64 having a plurality of holes secured therein and selectively secured to the other of the portions 62, 64 by means of a fastener. In the illustrated embodiment, the adjustment member 68 extends across and under the instep portion 30 of the planar member 12.

As is particularly evident in FIG. 3B, the heel binding 48 protrudes through the heel binding receiver 26 and secures to a boot heel receiver 70. For example, the boot 60 may include a groove or other member that engages the clamp 54. The toe binding 50 may likewise engage a boot toe receiver 72 that is embodied as a groove or other structure formed in the boot 60 and that engages the bail 56.

The snow climbing plate 10 described herein advantageously allows a snow climbing plate to be interposed between a crampon 44 and boot 60 with little or no adjustment. For example, a size setting for a crampon 44 that is only slightly loosened but still in an ideal setting range may be adjusted suitably for securement and use with a boot both with and without the snow climbing plate 10. Accordingly, a user is relieved of the need to adjust the crampon when installing and removing the snow climbing plate 10.

The snow climbing plate 10 additionally has no binding of its own and is therefore lighter in weight than a complete snowshoe. In some instances the disclosed snow climbing plate does not need to be removed when not required and when placement or removal is required, the process is little more complicated than removing and replacing a crampon.

As can be seen in FIG. 3B, climbing plate 10 ideally allows the front of the boot and toe spikes of the crampon to kick into the snow or ice for good grip. Yet the climbing plate still provides additional surface area to hold the climber from "post-holing" deep into the snow. Thus, climbing becomes more efficient and less taxing on the climber.

Figure 4:
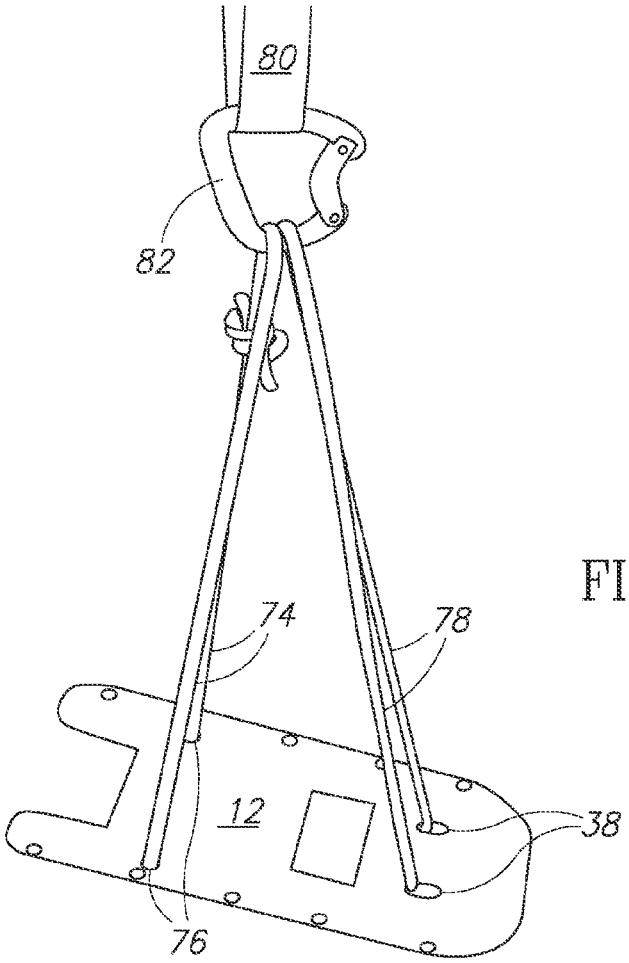
FIG. 4 is a perspective view of a snow climbing plate and ropes configured for use as a snow anchor in accordance with an embodiment of the present invention.
Figure 5:
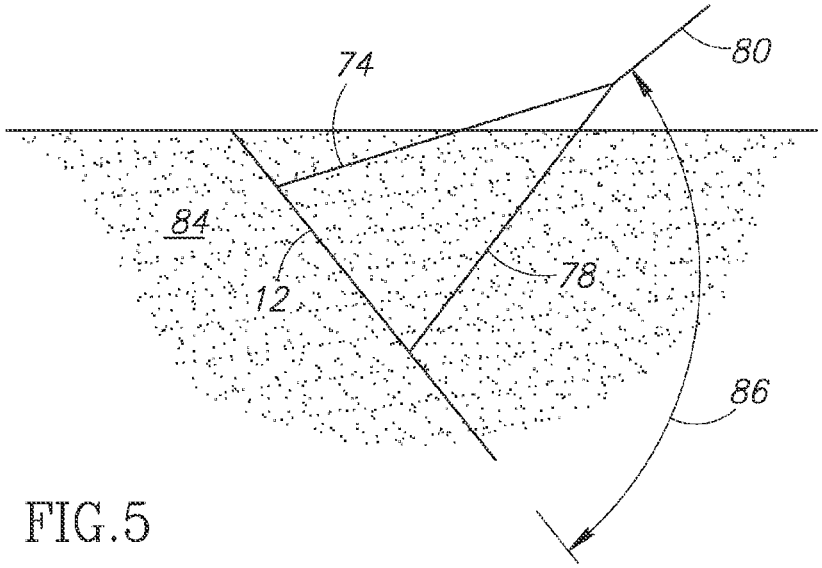
FIG. 5 is a side elevation view of a snow climbing plate deployed as a snow anchor in accordance with an embodiment of the present invention.

FIG. 4 illustrates a secondary use for a snow climbing plate 10 as a snow anchor for a tent or climbing rope. A pair of lines 74, which may be segments of a loop of line extend through apertures 76 near the toe binding receiver 28. In instances where lines 74 are part of a single loop, a segment of the loop may extend beneath the planar member 12 between the apertures 76. A pair of lines 78, which may also be part of a single loop of line, extend through the heel tab apertures 38. The lines 74 and lines 78 may secure to a tensioned line 80, or strap 80, such as by means of a karabiner 82 or some other fastener. As shown in FIG. 5, in use the planar member 12 may be embedded in snow 84 having an angle 86 with respect to the tensioned line 80 such that tensioning of the line 80 tends to urge the snow climbing plate deeper into the snow 84.

Figure 6A:
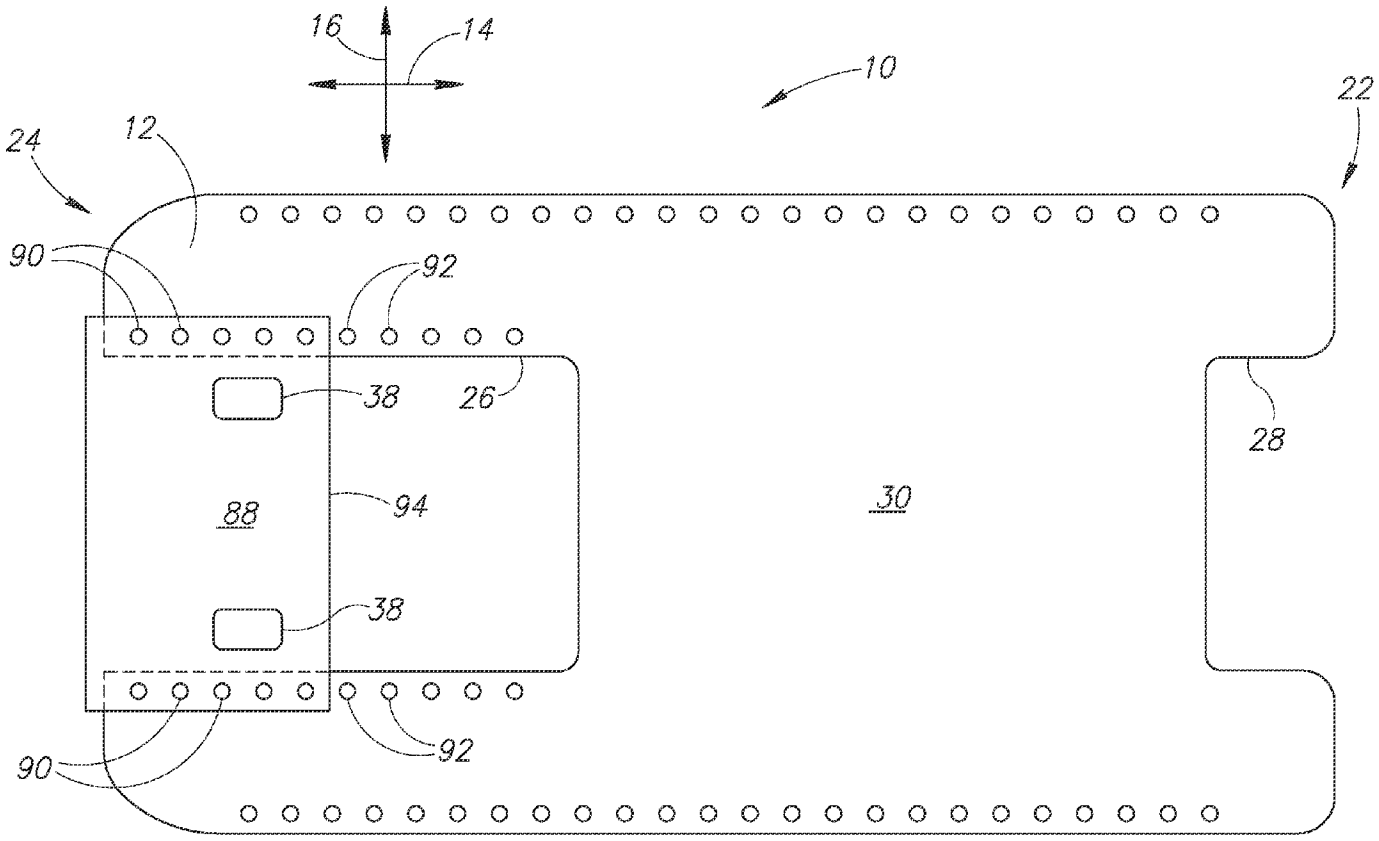
FIGS. 6A and 6B are top plan views of a snow climbing plate with an adjustable heel binding receiver in accordance with an embodiment of the present invention.
Figure 6B:
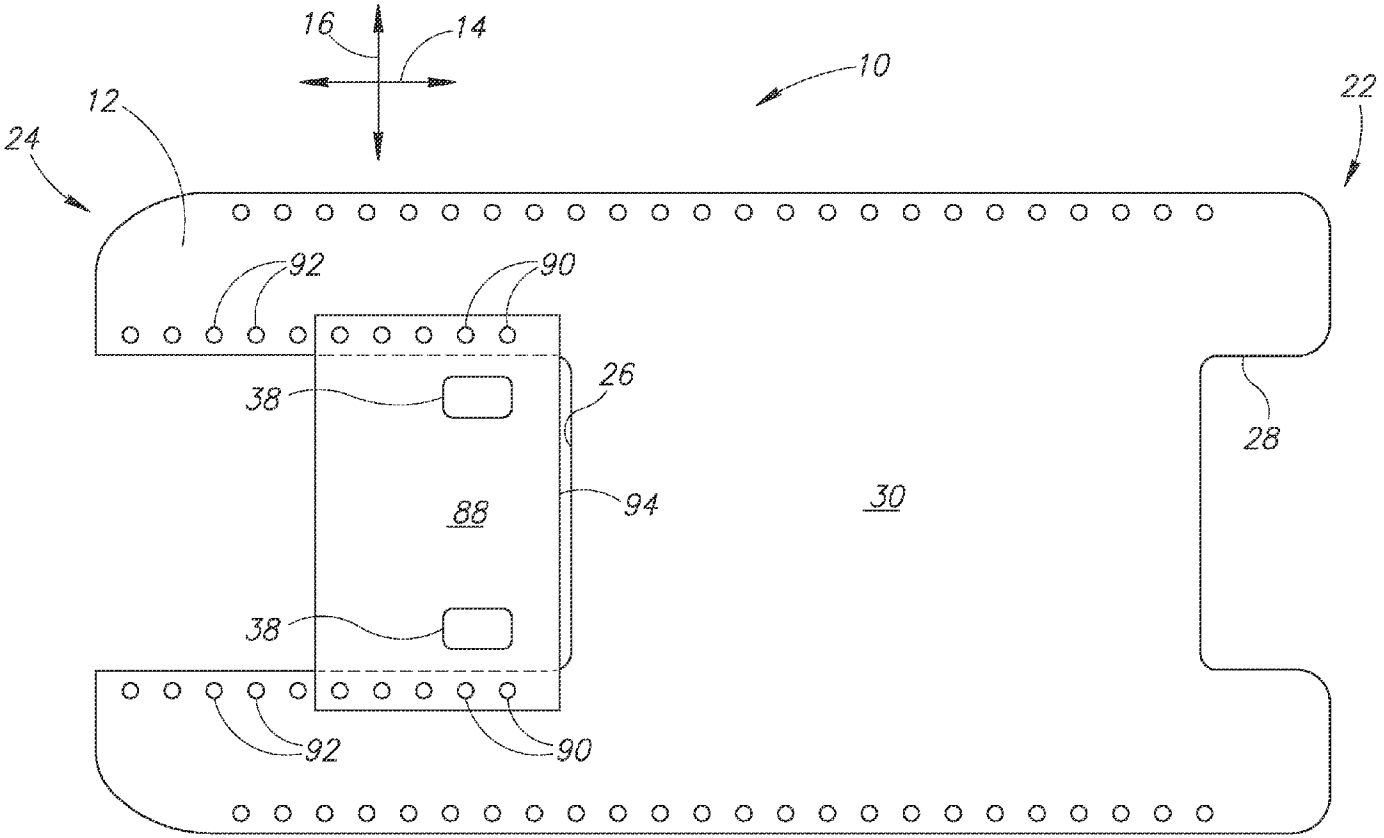

Referring to FIGS. 6A and 6B, in some embodiments one or both of the size and position of the heel binding receiver 26 of a snow climbing plate 10 may be adjustable in order to accommodate crampons and boots of differing sizes. For example, in the illustrated embodiment, the heel binding receiver 26 may be embodied as a notch 26 extending from the instep portion 30 to the heel end 24 of the planar member 12. For purposes of this disclosure, all of the attributes and embodiments of a heel binding receiver 26 may also be used to implement the toe binding receiver 28.

A sliding plate 88 may extend across the notch 26 in the lateral direction 16. The heel tab apertures 38 or tabs may be defined by the sliding plate 88. The sliding plate 88 may have a width in the longitudinal direction 14 that is less than the extent of the notch 26 in the longitudinal direction 14 such that the sliding plate 88 may be positioned at various longitudinal locations within the notch 26. The sliding plate 88 may also be positionable having a portion thereof extending rearwardly from the heel end 24 of the planar member 12. The sliding plate 88 may secure to the planar member 12 on either side of the notch 26 by any fastening means. The fastening means may require tools to remove and install or may be removable and installable without tools. For example, the fastening means may be screws, bolts, wing nuts, quick release fasteners, or the like.

In the illustrated embodiment, the sliding plate 88 may include one or more opposing pairs of apertures 90 positioned adjacent longitudinally extending edges of the sliding plate 88. The planar member 12 may likewise include one or more apertures 92 positioned adjacent the longitudinally extending edges of the notch 26 and each positioned to selectively align with an aperture of the apertures 90. Various configurations of the apertures 90 and the apertures 92 may be used. For example, adjustability may be achieved with one or more pairs of apertures 90 and a plurality of pairs of apertures 92 spaced apart along the longitudinally extending edges of the notch 26. Alternatively, a one or more pairs of apertures of 92 may engage any of a plurality of pairs of apertures 90 formed in the plate 88. Although apertures are shown in the illustrated embodiment, any structure enabling registration of the sliding plate 88 at various longitudinal positions along the notch 26 and fastening to the planar member 12. For example, rather than apertures, one or both of the apertures 90 and apertures 92 may be replaced with notches.

As is apparent in FIGS. 6A and 6B the described configuration enables the plate 88 to be fastened to the planar member 12 at various positions along the longitudinal direction 14. Accordingly, the leading edge 94 of the sliding plate 88 is likewise able to be positioned at different longitudinal positions. Accordingly, the size of the aperture formed by the leading edge 94 and the notch 26 varies. Accordingly, the heel binding 48 extending therethrough may be positioned as far rearwardly as the edge 94 and the edge 94 may be positioned as far forwardly as the rear side of the heel binding 48 depending on the size and preferences of the wearer. The adjustability of the sliding plate 88 additionally enables the accommodation of different types of crampon bindings (e.g. for boots with and without receivers for bindings) and different types of boots (e.g. soft or rigid)

Figure 7:
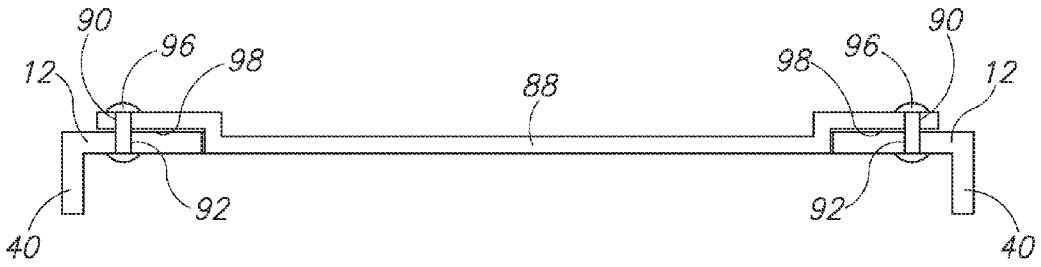
FIG. 7 is an end cross-sectional view of the snow climbing plate of FIGS. 6A and 6B.

FIG. 7 illustrates an example of how a sliding plate 88 may secure to the planar member 12. One or more pairs of fasteners 96, such as screw, bolt, any type of quick release fastener, or the like, may extend through opposing apertures 90 and opposing apertures 92 and secure the sliding plate 88 to the planar member 12. In some embodiments, the sliding plate 88 may define a receiver 98, such as a notch or recess, that receives the sides of the notch 26 and resists in-plane rotation of the plate 88 and enables smooth sliding of the sliding plate 88 during adjustment. Alternatively, the receiver 98 may be formed in the planar member 12 and be sized to receive a portion of the sliding plate 88.

Figure 8:
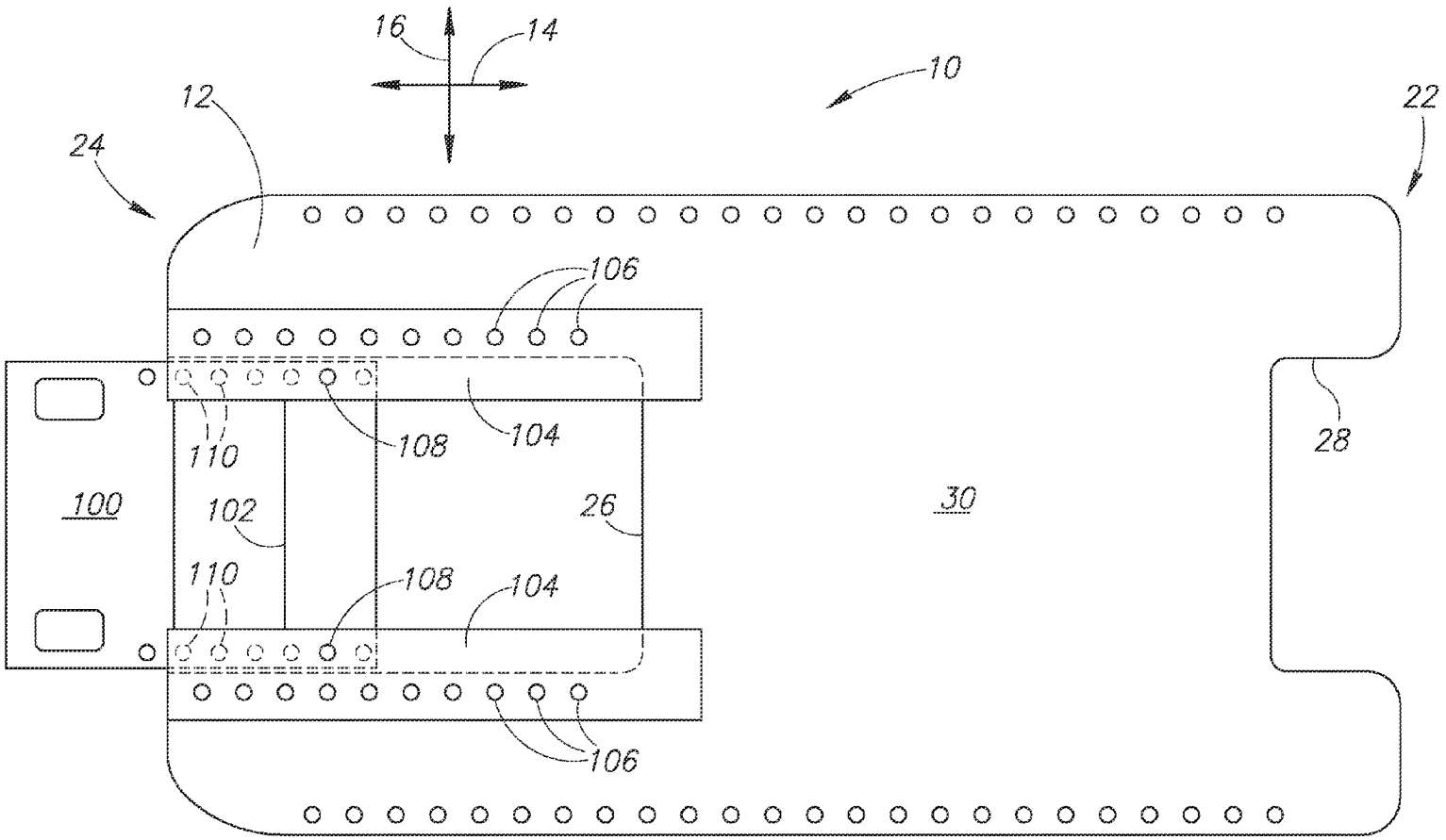
FIG. 8 is a top plan view of an alternative embodiment of a snow climbing plate with an adjustable heel binding receiver in accordance with an embodiment of the present invention.

FIG. 8 illustrates an alternative embodiment of an adjustable snow climbing plate 10. As for the embodiment of FIGS. 6A and 6B, a sliding plate 100 may be positioned within the notch 26 and be adjustable in the longitudinal direction 14 within the notch 26. The sliding plate 100 may define the heel tab apertures 38. In the embodiment of FIG. 8, the sliding plate 100 may include an aperture 102 sized to receive a heel binding. For example, the aperture 102 may have an extent in the longitudinal direction 14 sufficient to accommodate the longitudinal width of the binding with some tolerance and an extent in the lateral direction sufficient to accommodate at least the lateral width of the binding.

Figure 9:
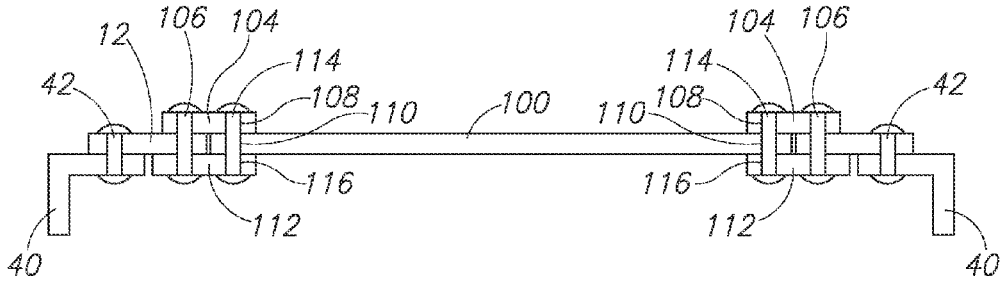
FIG. 9 is an end cross-sectional view of the snow climbing plate of FIG. 8.

FIGS. 8 and 9 additionally illustrate a different way to secure a sliding plate to the planar member 12, including both the sliding plate 88 of FIGS. 6A and 6B and the sliding plate 100. As shown in FIG. 8, the sliding plate 100 may be captured by a pair of flanges 104 each secured to the planar member 12 and extending along one of the longitudinally extending edges of the notch 26. The flanges 104 may extend partially inwardly over the notch 26 in order to capture a portion of the sliding plate 100 positioned within the notch 26.

The flanges 104 may secure to the planar member 12 by means of fasteners 106. The fasteners 106 may be embodied as any removable fastening means such as screws or bolts. The fasteners 106 may also be embodied as any permanent fastener such as rivets, welds, or the like. In some embodiments, the flange 104 may be formed by deformation of the planar member to define a recessed area for receiving the lateral portions of the sliding plate 102. The flanges 104 may define one or more opposing pairs of apertures 108 positioned over the notch 26 and positioned to engage a fastener engaging the sliding plate 100 in order to fix the position of the sliding plate 100 within the notch 26. In some embodiments, the fastener used may be such that only the flanges 104 and corresponding fasteners are required to retain the sliding plate 100 within the notch 26. The sliding plate 100 may include one or more opposing pairs of apertures 110 distributed along the edges thereof and positionable to overlap the apertures 108 at various positions. As an alternative, one or more pairs of apertures 110 may be positionable to engage any of a plurality of pairs of apertures 108 in the flanges 104.

Referring to FIG. 9, while still referring to FIG. 8, in other embodiments, a pair of lower flanges 112 may secure to the lower surface of the planar member 12 opposite the flanges 104. The lower flanges 112 may extend under the notch 26 such that a portion of the sliding plate 100 is captured between the flanges 104 and the lower flanges 112. In some embodiments, the same fasteners 106 may secure both the flange 104 and lower flange 112 to the planar member 12. As is also apparent in FIG. 9, a fastener 114 that engages an aperture 108 and aperture 110 may likewise engage an aperture 116 in the lower flange 112. As for the flanges 104, the lower flanges 112 may also secure to the planar member 12 by means of welds or any other fastening means. In some embodiments, the lower flange 112 is formed by deforming the planar member 12 to define a recess for receiving lateral portions of the sliding plate 100.

Figure 10:
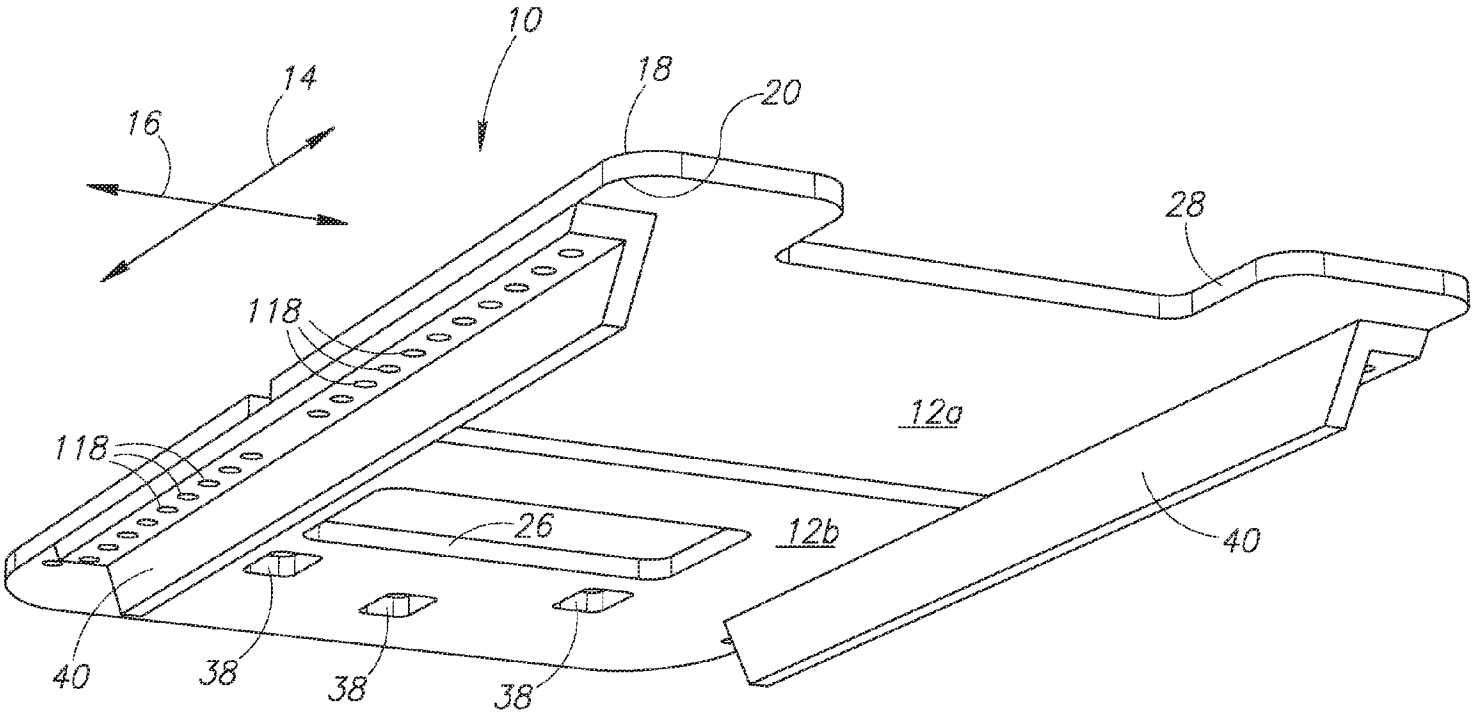
FIG. 10 is an isometric view of a snow climbing plate having adjustable front and rear planar member portions in accordance with an embodiment of the present invention.

Referring to FIG. 10, in some embodiments, adjustability of the snow climbing plate 10 may be achieved by dividing the planar member 12 into a forward planar member 12*a* and a rearward planar member 12*b*. The forward planar member 12*a* may define the toe binding receiver 28 and the rearward planar member 12*b* may define the heel binding receiver 26 and any heel tab apertures 38. The separation between the forward and rearward planar members 12*a*, 12*b* may be adjusted by adjusting the point of securement of the forward and rearward planar members 12*a*, 12*b* to the ribs 40. For example, the ribs 40 may define longitudinally distributed apertures 118 positioned to receive fasteners securing the forward and rearward planar members 12*a*, 12*b* to the ribs 40 at various positions.

Figure 11:
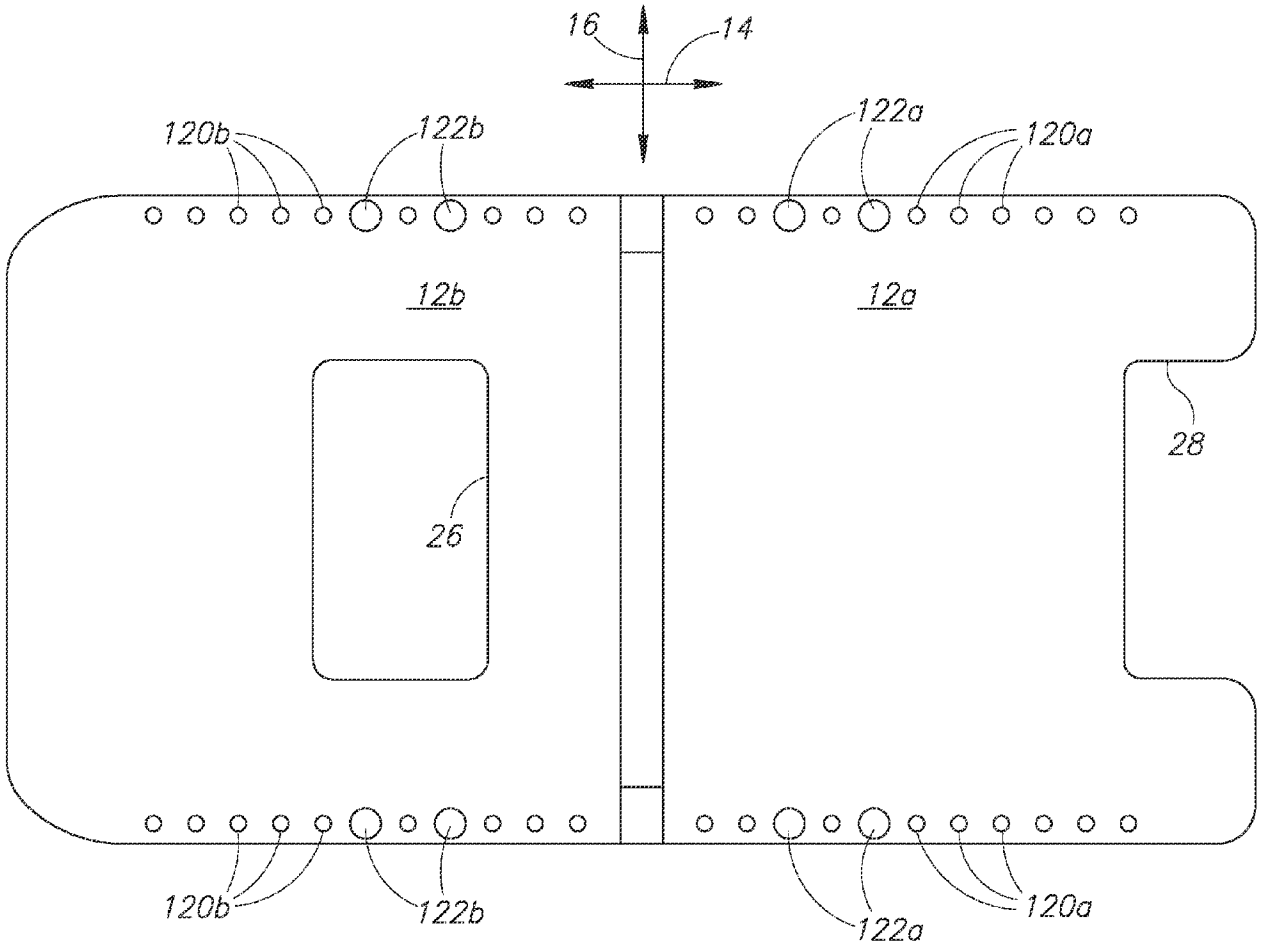
FIG. 11 is a top plan view of the snow climbing plate of FIG. 10.

Referring to FIG. 11, while still referring to FIG. 10, the ribs 40 may define one or more apertures 118. The forward and rearward planar members 12*a*, 12*b* may define one or more pairs of opposing apertures 120*a*, 120*b*, respectively that are alignable with one or more apertures 118 of the ribs 40. For example, the apertures 120*a*, 120*b* may be positioned along lateral edges of the forward and rearward planar members 12*a*, 12*b*, respectively. Fasteners 122*a* may extend through apertures 120*a* and apertures 118 of the ribs 40 to fix the position of the forward planar member 12*a* with respect to the ribs 40. Likewise, fasteners 122*b* may extend through apertures 120*b* and engage apertures 116 of the ribs 400 to fix the position of the rearward planar member 12*b* with respect to the rib.

In the illustrated embodiment, the ribs 40, which provide one or both of stiffening and traction functions are used to adjust the position of the planar members 12*a*, 12*b*. In other embodiments, the apertures 118 may be formed in one or more longitudinally extending members and the apertures 120*a*, 120*b* may be positioned to be selectively secured to these apertures. In such embodiments, the ribs 40 may be omitted or each planar member 12*a*, 12*b* may have portions of the ribs 40 formed thereon or secured thereto in order to provide stiffening and fraction functions.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A method for fastening a planar member to a boot, the planar member having a top surface and a bottom surface, the boot including a sole with a bottom surface, the method comprising:

positioning the planar member between the boot and a crampon, the crampon having a heel binding including a bail and a clamping member, wherein the bail and clamping member extend through a heel aperture in the planar member and a toe binding of the crampon extends through a toe binding receiver in the planar member such that the planar member is captured between the boot and a sole portion of the crampon, at least a portion of the bottom surface of the boot sole engaging a central portion of the top surface of the planar member, and a central portion of the bottom surface of the planar member engaging a top surface of the crampon, the crampon including spikes that project downwardly from the bottom surface of the crampon;

securing the heel binding of the crampon to a heel portion of the boot; and securing the toe binding of the crampon to a toe portion of the boot;

the planar member having a lateral extent beyond the sides of the crampon of at least 25% of the width of the sole portion of the crampon, to allow the spikes and the toe portion of the boot to kick into snow or ice for improved grip, while providing additional surface area to prevent a wearer's foot from sinking into the snow or ice.

2. The method of claim 1, further comprising positioning at least one heel tab of the crampon in a heel tab aperture positioned having the heel aperture positioned between the heel tab aperture and the toe binding receiver, the heel tab aperture being a separate aperture from the heel aperture.

3. The method of claim 1, wherein the planar member further comprises at least one rib extending continuously and longitudinally along most of the length of the planar member.

4. The method of claim 1, wherein the planar member comprises at least one rib secured at a lateral edge of the planar member and extending downwardly from a lower surface thereof, continuously along most of the length of the planar member.

5. The method of claim 1, wherein the toe binding receiver comprises an open-ended notch extending from a toe end of the planar member toward the heel aperture, such that the notch is open to the front extent of the planar member.

6. The method of claim 1, wherein the planar member extends rearwardly from the sole portion of the crampon, rearward of both the boot and the crampon.

7. The method of claim 6, wherein the planar member does not extend forwardly from the sole portion.

8. The method of claim 1, wherein the crampon includes a heel portion, a toe portion, and an adjustment member secured between the heel portion and the toe portion, the adjustment member being positioned beneath a central portion of the bottom surface of the planar member.

9. An apparatus comprising:

a boot having a sole with a bottom surface;

a crampon having spikes protruding from a bottom surface of a sole portion of the crampon, and heel and toe bindings extending from a top surface of the sole portion of the crampon, the heel binding having a bail and a clamping member for engaging the boot; and a planar member positioned between the boot and the crampon, the planar member having a top surface central portion adapted to engage the bottom surface of the boot sole, and a bottom surface central portion adapted to engage the top surface of the crampon, the planar member also including:

a heel aperture positioned having the bail of the heel binding extending therethrough, the clamping member of the heel binding engaging a heel portion of the boot; and a toe aperture having the toe binding extending therethrough and engaging a toe portion of the boot such that a portion of the planar member between the heel aperture and toe aperture is interposed between the boot and a portion of the sole portion of the crampon;

the planar member having a lateral extent beyond the sides of the crampon of at least 25% of the width of the sole portion of the crampon, to allow the spikes and the toe portion of the boot to kick into snow or ice for improved grip, while providing additional surface area to prevent a wearer's foot from sinking into the snow or ice.

10. The apparatus of claim 9, further comprising at least one rib secured to a lower surface of the planar member.

11. The apparatus of claim 9, wherein the planar member further comprises a heel tab aperture positioned having the heel aperture positioned between the heel tab aperture and the toe aperture, the heel tab aperture having a heel tab of the crampon positioned therein and comprising a separate aperture from the heel aperture.

12. The apparatus of claim 9, wherein the crampon includes a heel portion, a toe portion, and an adjustment member secured between the heel portion and the toe portion, the adjustment member being positioned beneath a central portion of the bottom surface of the planar member.

* * * * *